US009401092B2

(12) United States Patent
Pereira

(10) Patent No.: US 9,401,092 B2
(45) Date of Patent: Jul. 26, 2016

(54) SYSTEM AND METHOD FOR AIRPORT CONTROL USING WAKE DURATION

(71) Applicant: GE Aviation Systems LLC, Grand Rapids, MI (US)

(72) Inventor: Frazer Leslie Pereira, Mumbai (IN)

(73) Assignee: GE AVIATION SYSTEMS LLC, Grand Rapids, MI (US)

( * ) Notice: Subject to any disclaimer, the term of this patent is extended or adjusted under 35 U.S.C. 154(b) by 0 days.

(21) Appl. No.: 14/497,463

(22) Filed: Sep. 26, 2014

(65) Prior Publication Data

US 2016/0093224 A1 Mar. 31, 2016

(51) Int. Cl.
*G08G 5/00* (2006.01)

(52) U.S. Cl.
CPC ..... *G08G 5/0095* (2013.01); *G08G 5/0026* (2013.01); *G08G 5/0043* (2013.01); *G08G 5/0082* (2013.01); *G08G 5/0091* (2013.01)

(58) Field of Classification Search
CPC . G08G 5/0095; G08G 5/0091; G08G 5/0026; G08G 5/0082; G08G 5/0043
See application file for complete search history.

(56) References Cited

U.S. PATENT DOCUMENTS 5,845,874 A 12/1998 Beasley
8,478,459 B2 7/2013 Mutuel et al.
8,629,787 B1 * 1/2014 Rathinam ..... G08G 5/0013 340/963
2002/0024652 A1 * 2/2002 Ooga ..... G01P 5/26 356/28.5
2003/0222795 A1 12/2003 Holforty et al.
2008/0030375 A1 * 2/2008 Cotton ..... G01S 17/023 340/945
2008/0035784 A1 2/2008 Meserole et al.
2010/0063716 A1 3/2010 Brozat
2010/0117892 A1 * 5/2010 Barbaresco ..... G01S 13/951 342/26 R
2011/0004398 A1 1/2011 Stayton et al.
2011/0098872 A1 4/2011 Lewis
2013/0013182 A1 1/2013 Bertsimas et al.
2014/0236470 A1 * 8/2014 Lafon ..... G08G 5/065 701/301
2015/0269846 A1 * 9/2015 De Prins ..... G08G 5/0043 701/120

OTHER PUBLICATIONS

Great Britain Combined Search and Examination Report issued in connection with Corresponding GB Application No. 1516857.8 on Mar. 8, 2016.

* cited by examiner

*Primary Examiner* — Mary Cheung
(74) *Attorney, Agent, or Firm* — GE Global Patent Operation; William S. Munnerlyn

(57) ABSTRACT

A system and method for airport control at an airport having one or more runways. The system and method can receive information related to aircraft utilizing the airport, determine wake duration, and determine an aircraft separation time for one or more runways based on a wake duration of an aircraft.

17 Claims, 2 Drawing Sheets

SYSTEM AND METHOD FOR AIRPORT CONTROL USING WAKE DURATION

BACKGROUND OF THE INVENTION

Wake turbulence is a product of aircraft take-off and landing, the strength of which is governed by the weight, speed, and wing-span of the aircraft. Wake turbulence may also be effected by environmental conditions. A following aircraft needs to avoid the wake turbulence of the leading aircraft for safety, so runway take-offs and landings are spaced apart to allow time for the strength of the wake turbulence of a leading aircraft to decay to a safe level. The spacing required for safe runway usage is a limiting factor in airport capacity and some airports merely use a set time frame for all following aircraft regardless of other factors.

BRIEF DESCRIPTION OF THE INVENTION

In one aspect, an embodiment of the invention relates to a method of air traffic control at an airport having at least one runway, the method comprising sensing an aircraft type for an aircraft landing or taking off on the at least one runway, sensing wind conditions at the least one runway corresponding to the landing or taking off of the aircraft, providing the sensed aircraft type and wind conditions as input to a software-implemented algorithm to determine a wake duration, setting an aircraft separation time based on the determined wake duration, and controlling the usage of the at least one runway based on the set aircraft separation time.

In another aspect, an embodiment of the invention relates to an airport surface management system comprising a timing module configured to receive information related to aircraft utilizing the airport, determine wake duration, and determine an aircraft separation time for a runway based on determined wake duration, and a communication module for providing an indication of the aircraft separation time to an operator.

DESCRIPTION OF EMBODIMENTS OF THE INVENTION

Wake turbulence results from the forces that the lift the aircraft. Air moves outwards under the wings of the aircraft and curls up and over the wings, creating a pair of counter-rotating vortices which trail from the wingtips. The strength of wake turbulence is primarily determined by the weight, speed, and wing-span of the aircraft.

Figure 1:
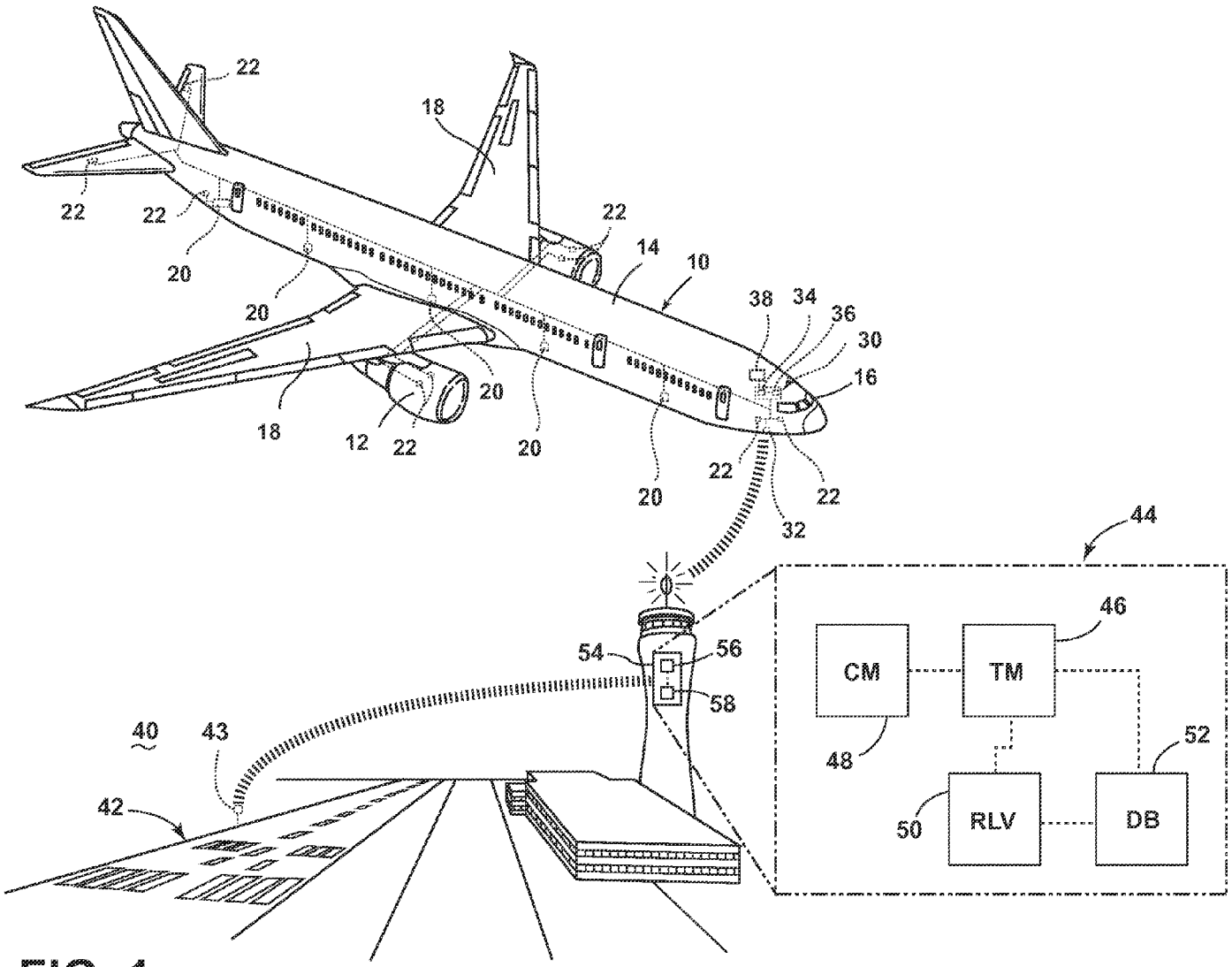
FIG. 1 is a perspective view of an aircraft and an airport in which embodiments of the invention may be implemented.

FIG. 1 is a perspective view of an aircraft 10 and an airport 40 in which embodiments of the invention may be implemented. The aircraft 10 may include one or more propulsion engines 12 coupled to a fuselage 14, a cockpit 16 positioned in the fuselage 14, and wing assemblies 18 extending outward from the fuselage 14. A plurality of additional aircraft systems 20 that enable proper operation of the aircraft 10 may also be included in the aircraft 10. Further, one or more sensors 22 may be included, and each may output data relevant to the aircraft 10. For example, sensors 22 related to the engine 12 may provide data regarding temperatures, pressures, fuel flow and spool speed for the engine 12, while another sensor 22 related to embodiments of the method and system of the invention may provide data regarding the aircraft type based on one or more of the weight, speed, and wing-span of the aircraft 10. By way of non-limiting example, a jet aircraft has been illustrated in FIG. 1, but it is understood that other types of aircraft, including helicopters, form wake turbulence.

A controller 30 and a communication system having a wireless communication link 32 may also be included in the aircraft 10. The controller 30 may be operably coupled to the engines 12, plurality of aircraft systems 20, the sensors 22, etc. The controller 30 may also be connected with other controllers of the aircraft 10. The controller 30 may include a memory 34, which may be in the form of a random access memory (RAM), read-only memory (ROM), flash memory, or one or more different types of portable electronic memory, such as discs, DVDs, CD-ROMs, etc., or any suitable combination of these types of memory. The controller 30 may include one or more processors 36, which may be running any suitable programs.

A flight display 38 may be operably coupled with the controller 30 and the controller 30 may drive the flight display 38 to generate a display thereon. In this manner, the flight display 38 may visually express information pertaining to the aircraft 10. The flight display 38 may be a primary flight display, a multipurpose control display unit, or other suitable flight display commonly included within the cockpit 16 including a handheld device.

The airport 40 includes one or more runways 42 at which aircraft may take off or land, and an airport surface management system (ASMS) 44. A typical commercial airport may have multiple adjacent runways 42, such as runways that run parallel to each other or runways that intersect each other. The runway 42 may have one or more associated sensor(s) 43, which sense a runway condition, such as the wind conditions and/or the wetness of the runway 42.

The ASMS 44 may factor in wake turbulence to control runway usage. The ASMS 44 may include a timing module 46 operably coupled with a communication module 48. The timing module 46 is configured to receive information related to aircraft utilizing the airport 40, determine the wake duration of at least one aircraft utilizing the airport 40, and determine an aircraft separation time for a runway 42 based on determined wake duration. In order to make these determinations, the timing module 46 may receive real-time information from various sources, including the aircraft 10, the runway sensor 43, etc.

The communication module 48 provides an indication of the aircraft separation time to at least one operator, such as an air traffic controller at the airport 40 or a pilot of the aircraft 10. In one example, the communication module 48 may provide the aircraft separation time to the pilot of the aircraft 10 via the wireless communication link 32 for display on the flight display 38.

The ASMS 44 can further include a runway landing and vacating (RLV) module 50 operably coupled with the timing module 46. The RLV module 50 can be configured to determine a braking profile for an aircraft. The braking profile is based on information such as real-time runway wetness (including whether the runway has wet, dry, or icy patches), conditions monitored by runway sensors, and the condition of aircraft brakes, and provides the aircraft with braking and turning assistance (such as landing point, deceleration profile, etc.) for an assigned runway. The RLV module 50 can further provide information on the assigned airport gate to the aircraft, including directions to the assigned gate. The RLV module 50 can be configured to provide the braking profile to the timing module 46. The timing module 46 can then determine the aircraft separation time based on the braking profile in addition to the wake duration.

The ASMS 44 can further include an airport mapping database 52 that is accessible by the timing module 46 and RLV module 50. The mapping database 52 contains 2D and 3D information on airport surfaces, including runways and gates, and enables the timing module to identify critical areas related to wake turbulence on the airport surface. Identification of critical wake areas may enable improved safety and efficiency of ground operations. For example, a 2D map can be exported to mobile devices of all airport employees (especially ground staff) so that they can identify their locations with respect to the airport surface and any critical wake areas.

The ASMS 44 may be implemented as a computer program on an airport computer 54 having an executable instruction set for controlling air traffic and runway usage, particularly as related to the take-off or landing of the aircraft 10 at a runway of the airport 40, that can be modeled by one or more algorithms, including a wake algorithm and a braking algorithm. The wake algorithm can simulate wake as a function of the current, previous, and next aircraft to use a runway, crosswind conditions on the runway, meteorological effects, and the flight profiles for adjacent runways. The braking algorithm can determine a runway braking operation as a function of the braking profile, runway wetness, predicted descent point to allocated gate distance, and aircraft speed profile. The braking profile is the current condition of aircraft brakes taking into account the most recent braking events and brake maintenance logs.

The program for implementing the ASMS 44 may include a computer program product that may include machine-readable media for carrying or having machine-executable instructions or data structures stored thereon. Such machine-readable media may be any available media, which can be accessed by a general purpose or special purpose computer or other machine with a processor. Generally, such a computer program may include routines, programs, objects, components, data structures, algorithms, etc., that have the technical effect of performing particular tasks or implement particular abstract data types. Machine-executable instructions, associated data structures, and programs represent examples of program code for executing the exchange of information as disclosed herein. Machine-executable instructions may include, for example, instructions and data, which cause a general purpose computer, special purpose computer, or special purpose processing machine to perform a certain function or group of functions.

The computer 54 shown herein includes at least a memory 56, which may be in the form of a random access memory (RAM), read-only memory (ROM), flash memory, or one or more different types of portable electronic memory, such as discs, DVDs, CD-ROMs, etc., or any suitable combination of these types of memory. The computer 54 may further include one or more processors 58, which run the program for implementing the ASMS 44.

While an airport computer 54 has been illustrated, it is contemplated that portions of the embodiments of the invention may be implemented anywhere, including in the controller 30 of the aircraft 10. Furthermore, while a commercial jet aircraft 10 has been illustrated, it is contemplated that portions of the embodiments of the invention may be implemented for other types of aircraft as well.

Figure 2:
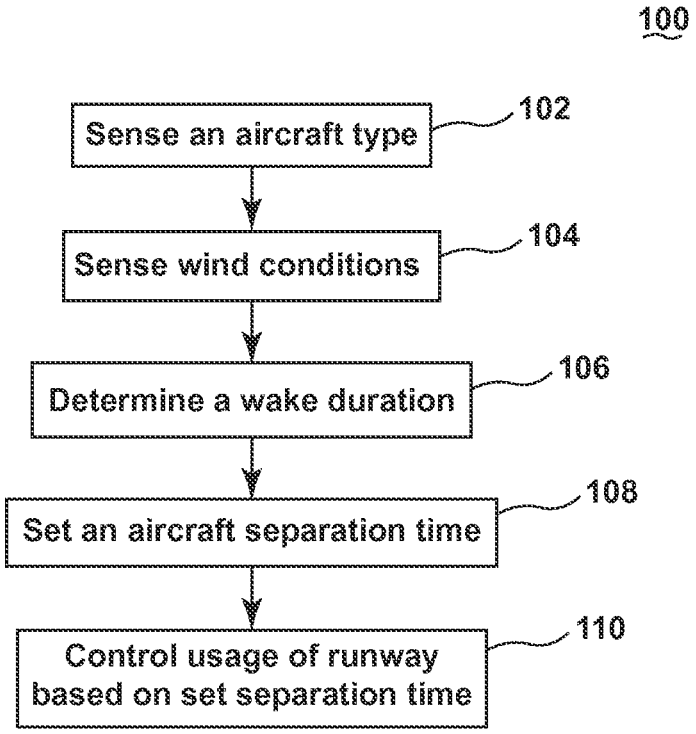
FIG. 2 is a flowchart showing a method of air traffic control according to an embodiment of the invention.

In accordance with an embodiment of the invention, FIG. 2 illustrates a method 100, which may be used for air traffic control at an airport having one or more runways at which aircraft may take off and/or land. The method 100 factors in wake turbulence to control runway usage. The method 100 can be modeled by one or more algorithms which may be implemented by the ASMS 44 described with respect to FIG. 1. It is noted that the sequence of steps discussed is for illustrative purposes only and is not meant to limit the method in any way as it is understood that the steps may proceed in a different logical order, additional or intervening steps may be included, or described steps may be divided into multiple steps, without detracting from the embodiments of the invention.

The method 100 begins at 102 sensing an aircraft type for an aircraft landing or taking off on a runway of the airport. The aircraft type may be sensed by an airport sensor or an aircraft sensor, and can be based on the weight, speed, and/or wing-span of the aircraft. In one example, with reference to FIG. 1, a sensor 22 of the aircraft 10 may communicate the aircraft type to the ASMS 44 via the wireless communication link 32 with the communication module 48.

At 104, the wind conditions on the corresponding runway are sensed. Wind conditions may be sensed by airport weather sensors, GPS/airport weather information, aircraft sensors including aircraft that have previously taken off or landed, or by monitoring crosswind conditions on the runway, or by any combination thereof. In one example, with reference to FIG. 1, the sensor 43 on the runway 42 may communicate wind conditions to the ASMS 44 via a wireless communication link with the communication module 48. In another example, still with reference to FIG. 1, a sensor 22 of the aircraft 10 may communicate wind conditions to the ASMS 44 via the wireless communication link 32 with the communication module 48.

The sensed aircraft type and wind conditions are provided as input to a software-implemented algorithm to determine a wake duration at 106. The wake duration is the time that the strength of the wake turbulence of the aircraft landing or taking off on a runway of the airport is above a predetermined level. The algorithm can be implemented by a wake simulator which include a database of simulated wake durations for various aircraft type and wind conditions. By comparing the sensed aircraft type and wind conditions to the database, the expected wake duration can be determined. It will be understood that larger aircrafts may create larger wakes and that smaller aircrafts may require longer duration as they may be more affected by such wakes. Further, cross winds may more quickly dissipate wake turbulence as compared to when there are no winds.

Other parameters can be factored in by the simulator when determining the wake duration at 106. For example, meteorological effects or flight profiles from adjacent runways (including those parallel to or intersecting the current runway) can be used to determine the wake duration. Meteorological effects can include by way of non-limiting examples precipitation, temperature, and humidity. Flight profiles can include the aircraft type, wind conditions, and/or wake duration from adjacent runways. One exemplary wake algorithm can simulate wake as a function of all of these parameters, including the current, previous, and next aircraft to use a runway, crosswind conditions on the runway, meteorological effects, and the flight profiles for adjacent runways.

Based on the wake duration determined at 106, an aircraft separation time can be set at 108. The aircraft separation time is a minimum time between a take-off and landing on the same runway. Further, because wake turbulence not only affects aircraft using the same runway but aircraft using parallel or intersecting runways. The aircraft separation time may also be determined for parallel runways and/or intersecting runways. A database of aircraft separation times for various wake durations can be available in order to set the aircraft separation time at 108. For example, with reference to FIG. 2, the database can be stored in the memory 56 of the computer 54 and accessible by the timing module 46 of the ASMS 44.

Other parameters can be factored in when determining the aircraft separation time at 108. For example, braking information can be used to determine the aircraft separation time. Braking information can include real-time runway wetness (including whether the runway has wet, dry, or icy patches), conditions monitored by runway sensors, and the condition of aircraft brakes. The braking information can be provided as input to a software-implemented algorithm to determine a runway braking operation. One exemplary braking algorithm can determine a runway braking operation as a function of the braking profile, runway wetness, predicted descent point to allocated gate distance, and aircraft speed profile. For example, with reference to FIG. 2, the RLV module 50 can determine the runway braking operation from this algorithm, and provide it to the aircraft 10 via the communication module 48. The timing module 46 can further determine the aircraft separation time based on the braking profile in addition to the wake duration determined at 106.

Based on the set aircraft separation time, the usage of the runway can be controlled at 110. Control of runway usage can include controlling the landing time for a subsequent aircraft to land on or take off from the runway, identifying aircraft types that are suitable for landing/take-off after the sensed aircraft type, and/or providing an alert or an indication of an alert regarding existing runway wake conditions and the profile and type of aircraft approaching the runway. For example, an alert can be generated if conditions on the runway are unsafe for an aircraft, such as if a small aircraft is approaching a runway after a large aircraft has just landed.

The method 100 can be carried out in real-time at an airport. For example, as an aircraft approaches an airport, the method 100 can be used to determine what time and on which runway the aircraft may land based on current wake durations on various runways and the anticipated wake duration of the approaching aircraft. The same is true can be done for aircraft scheduled to taking off from an airport. Thus, a real-time determination of aircraft separation time can be used to coordinate landings as well as take-offs.

In a further application, the method 100 can be implemented for multiple aircraft landing or taking off on different runways of the airport. By determining the wake duration for multiple aircraft at 106, the landing or take-off of the aircrafts can be coordinated by type and runway location so that the separation time is minimized, which can increase the airport's capacity.

It is also contemplated that, the data related to successful landings can be saved to create a database of profiles for future use. Data saved may include the type of the current aircraft landing on a runway, the type of aircraft which used the same runway before the current aircraft, the type of aircraft which will use the same runway after the current aircraft, the same aircraft information for adjacent runways, crosswind conditions, and other weather and/or environmental information. Once a set of landing profiles are created, they can be used as a reference to support future decisions for airport operations. Thus, the method 100 can further factor in previous landing profiles when setting the aircraft separation time at 108.

Technical effects of the embodiments include being able to accurately determine appropriate aircraft separation times based on the determined wake duration. The various embodiments of systems and methods disclosed herein provide improved air traffic control using wake turbulence detection. One advantage that may be realized in the practice of some embodiments of the described systems is that the wake turbulence detection system for runways can be combined with a runway landing and vacating system. The above described embodiments allow for improved airport capacity by increasing flight frequency and reducing flight delays. The above described embodiments also allow for improved airport safety, including the safety of runways, aircraft, and ground operations. Another advantage that may be realized in the practice of some embodiments of the described systems is that wear and tear on aircraft brakes is decreased by communicating an improved braking profile to the aircraft. Yet another advantage that may be realized in the practice of some embodiments of the described systems is that the systems and methods can be implemented without requiring new infrastructure on airports or aircrafts.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of air traffic control at an airport having at least one runway, comprising:

sensing an aircraft type for an aircraft landing or taking off on the at least one runway;

sensing wind conditions at the least one runway corresponding to the landing or taking off of the aircraft;

determining, based on a set of braking criteria, a runway braking operation for the aircraft;

providing the sensed aircraft type and wind conditions as input to a software-implemented algorithm to determine a wake duration;

setting an aircraft separation time based on the determined wake duration and runway braking operation; and controlling usage of the at least one runway based on the set aircraft separation time.

2. The method of claim 1 wherein controlling the usage comprises controlling the landing time for a subsequent aircraft to land on the at least one runway based on the set aircraft separation time.

3. The method of claim 1 wherein the wake duration is further based on meteorological effects or adjacent runway flight profiles.

4. The method of claim 3 wherein the wake duration is determined using a simulator that takes into account aircraft type, runway crosswind conditions, meteorological effects, and adjacent runway flight profiles.

5. The method of claim 1 wherein the airport comprises multiple runways and further comprising determining aircraft separation times for at least two of the multiple runways.

6. The method of claim 1 wherein controlling the usage comprises providing an indication of an alert regarding existing runway wake conditions and the type of aircraft approaching the runway.

7. The method of claim 1 wherein the aircraft separation time is further based on previous landing profiles.

8. The method of claim 1 wherein setting the aircraft separation time is further based on a type of a previous aircraft to use the at least one runway, a type of a next aircraft to use the at least one runway, adjacent runway information, or weather factors.

9. The method of claim 8 wherein adjacent runway information includes current, previous, and next aircraft type on an adjacent runway.

10. The method of claim 9, further comprising identifying critical areas related to wake on the at least one runway and providing an indication related to the identified critical areas.

11. The method of claim 1 wherein the aircraft separation time is determined in real-time.

12. The method of claim 1 wherein the set of braking criteria includes at least one of: a braking profile of an aircraft, a runway wetness, a predicted descent point to allocated gate distance, or an aircraft speed profile.

13. An airport surface management system, comprising:

a runway landing and vacating module configured to determine a braking profile for an aircraft;

a timing module configured to:

obtain the braking profile from the runway landing and vacating module;

receive information related to aircraft utilizing the airport;

determine wake duration; and determine an aircraft separation time for the runway based on the determined wake duration and braking profile; and a communication module configured to provide an indication of the aircraft separation time to an operator.

14. The airport surface management system of claim 13, further comprises an airport mapping database accessible by the timing module and the runway landing and vacating module.

15. The airport surface management system of claim 13, wherein the runway landing and vacating module is configured to determine the braking profile based at least in part on a runway wetness, a predicted descent point to allocated gate distance, or an aircraft speed profile.

16. The airport surface management system of claim 15, wherein the runway wetness includes a determination of that the runway has at least one of a wet patch, a dry patch, or an icy patch.

17. The airport surface management system of claim 15, wherein the timing module is further configured to determine the aircraft separation time based at least in part on adjacent runway flight profiles.

* * * * *